United States Patent [19]

Hanson

[11] 4,019,692

[45] Apr. 26, 1977

[54] REINFORCED REEL

[75] Inventor: Wallace E. Hanson, Hampden, Mass.

[73] Assignee: Champion International Corporation, Stamford, Conn.

[22] Filed: Dec. 18, 1975

[21] Appl. No.: 641,726

[52] U.S. Cl. ..... 242/71.8; 242/118.8

[51] Int. Cl.[2] ..... B65H 75/14

[58] Field of Search ..... 242/118.8, 71.8, 118.7, 242/118.4, 77

[56] References Cited

UNITED STATES PATENTS

| | | | |
|---|---|---|---|
| 1,052,303 | 2/1913 | Aven | 242/118.8 |
| 2,852,206 | 9/1958 | Bolding | 242/118.8 |
| 3,104,077 | 9/1963 | Struble | 242/118.8 |
| 3,838,602 | 10/1974 | Hanson et al. | 242/118.8 |

*Primary Examiner*—George F. Mautz
*Attorney, Agent, or Firm*—Evelyn M. Sommer

[57] ABSTRACT

A paperboard reel especially suitable for ribbon, lace and the like is an improvement upon U. S. Pat. No. 3,838,602 is made of paperboard and has a unique folding pattern for the various panels so that only one piece of paperboard has to be used and that each flange of the reel is comprised over its major areas of at least three and as much as four thicknesses of material. The structure is foldable from a blank to a flat knocked down form which can be erected to its final configuration.

13 Claims, 3 Drawing Figures

FIG. 2
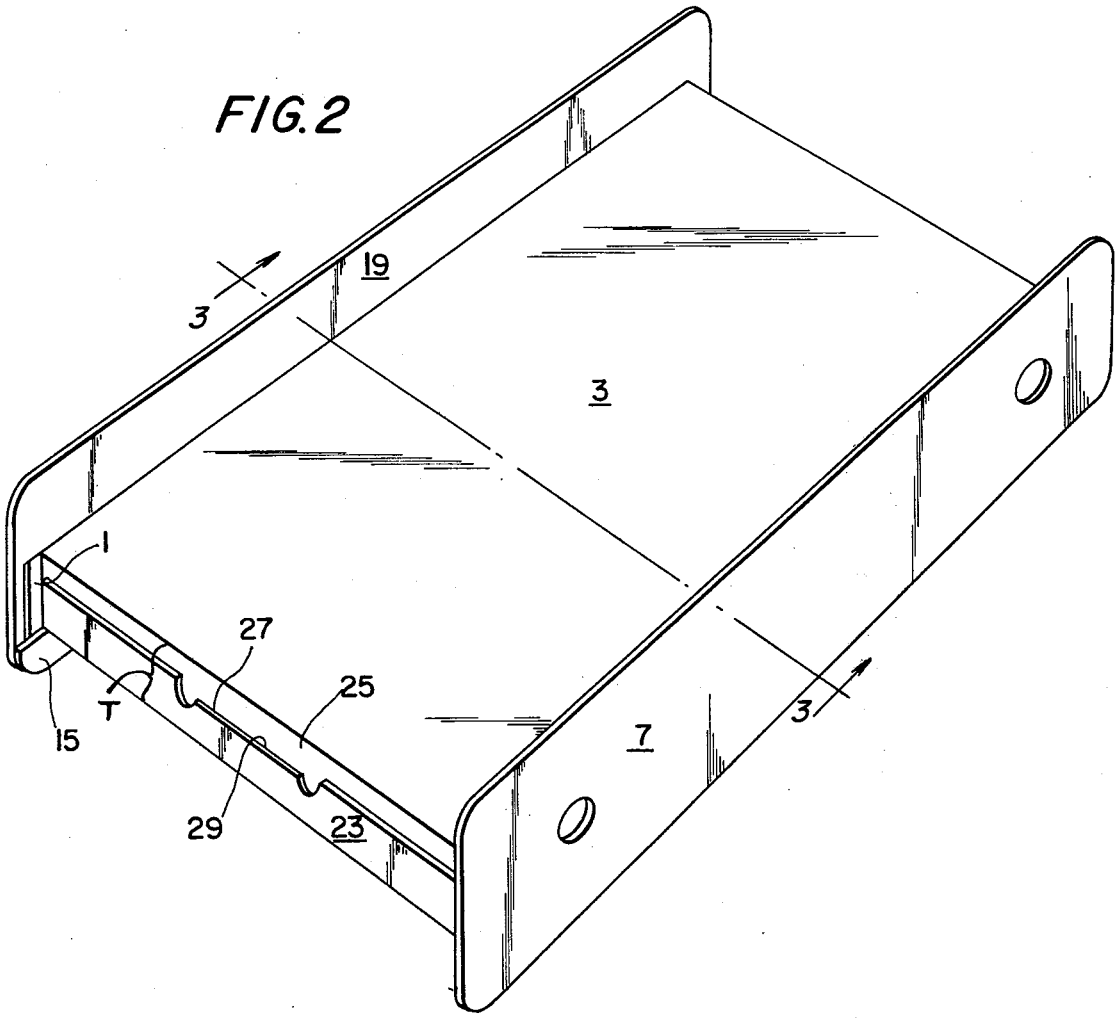
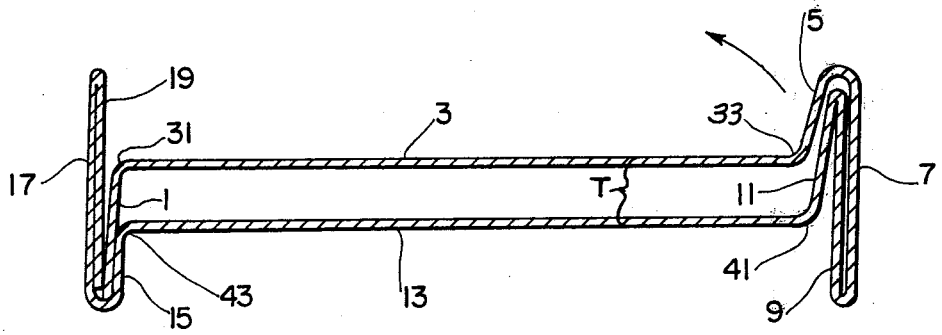
FIG. 3

REINFORCED REEL

BACKGROUND AND SUMMARY OF INVENTION

This invention relates to improvements in reels made of one piece of foldable material. One aspect of the invention relates to improved reels made of paperboard or the like. Another aspect of the invention relates to an improved reel wherein the side panels have additional layers of material provided as reinforcement.

Reels made according to the present invention are suitable for storing elongated lengths of materials such as ribbon, lace and the like in connection with which usage of the invention will, without being limited thereto, be described.

The prior art is best exemplified by U.S. Pat. No. 3,838,602 issued on Oct. 1, 1974 to this applicant, which discloses a reel made from a single blank which can be folded into flat knock-down form and thereafter readily erected into its useful form.

In that patent the reel ends, 9 and 15 as shown therein, are comparatively wide as compared to the thickness of the core exemplified as panel 23 in the patent. In actual practice following the teachings of U.S. Pat No. 3,838,602, the reel ends are approximately three times wider than the thickness of the core upon which the products are wound. Also, as disclosed in that patent, while the reel ends are reinforced by double and even four thicknesses of material at one reel end, the major areas of the reel ends are of two ply thickness in the areas where the reel is most likely to suffer damage, i.e. from the core area to the outside edges of the reel ends.

The present invention is an improvement over the structure disclosed in the prior patent in that, first it retains all of the advantages spelled out therein, secondly, the width of the reel ends can be drastically reduced to approximately only twice the thickness of the core and, thirdly, the reel ends are more effectively reinforced being comprised of no less than three plys of material over at least their major areas. A further advantage in the improved structure is found in the more efficient utilization of blank materials since the number of cut areas is vastly reduced and the blank is virtually a solid rectangle with no fancy edges which means that there is very little scrap loss since the entire area of the starting materials can be utilized in the blanking operation.

Accordingly, the present invention has for an object the making of a reel from a single paperboard blank which can be folded in such a manner that reinforcement is available across the major area of each side panel or reel flange, yet providing a structure that can be folded from a blank to a flat shipping construction and later erected and simply locked into its final configuration.

It is an object of the present invention to provide a reel made from a single piece of material.

A further object of the invention is to produce a blank which assures maximum usage of the raw material from which the blank is formed.

It is a further object of the present invention to provide a reel having improved reinforcement on its flanges.

Other object and advantages and features of the present invention will become apparent from the following description when read in conjunction with the drawings wherein:

FIG. 2 is an isometric view of reel erected from the blank of FIG. 1;

FIG. 3 shows the folding arrangement for the blank of FIGS. 1 and 2 as seen along section 3—3 of FIG. 2;

Figure 1:
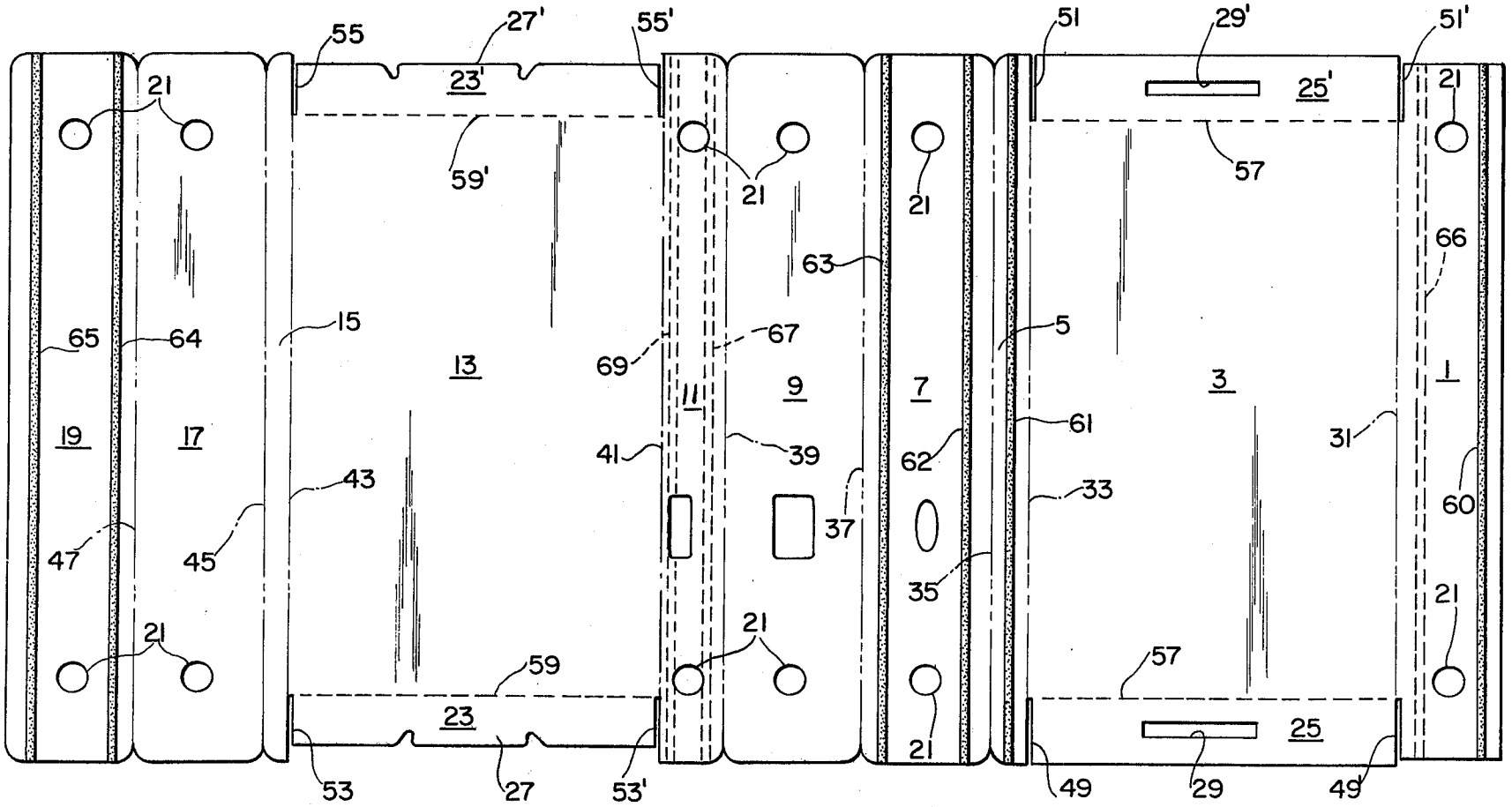
FIG. 1 is a plan view of a blank for making a reel according to the present invention.

Referring first to FIG. 1 the blank includes a series of panels separated from each other, as is a common practice in the art, by score lines or (where dictated by the type of material) by perforated or cutscore lines. The panels as seen in FIG. 1, and reading from right to left, are an anchor panel 1, a first hub panel 3, a first glue panel 5, a first outer side panel 7, a first major reinforcing panel 9, a first minor reinforcing panel 11, a second hub panel 13, a second minor reinforcing panel 15, a second outer side panel 17, and a second major reinforcing panel 19.

Shaft holes 21 are cut out of the anchor, the first and second major outer side panels, the first and second reinforcing panels, and the first minor reinforcing panel 1, 7, 17, 9, 19, and 11 respectively. These shaft holes are for receiving the shafts on a ribbon winding machine so that the reel can be loaded on said machine, rotated rapidly and filled up with ribbon and thereby prepared for market, when the reel is set up as disclosed in FIG. 2.

At each end of the first and second hub panels 3 and 13 are hub locking flaps 25, 25', and 23, 23' respectively which are foldable inwardly of the reel toward and in overlapping relationship with one another as shown in FIG. 2. The locking flaps 23, 23$^1$ are provided with lock tabs 27, 27$^1$ which engage within lock apertures 29, 29$^1$provided in flaps 25, 25$^1$ to hold the reel in erected condition as shown in FIG. 2.

The width of the locking flaps is more than one-half the thickness T of the hub see FIG. 3 whereby an overlapping relationship is insured. It would of course be possible to glue the locking flaps to one another in which case the tops and apertures would be eliminated. Even so the width of the locking flaps would still be greater than one-half of the hub thickness T. The panels are, as noted above, respectively separated one from another by score lines or cutscore lines, as the case may be. Reading from left to right as viewed in FIG. 1, the score lines 31, 33, 35, 37, 39, 41, 43, 45 and 47 separate the respective panels in the order above named one from another and also thereby define the panel edges, fold lines, and common hinges shared by one another.

Other features which should be observed in FIG. 1 are the slots, 49, 49$^1$, 51, 51$^1$ in hub panel 3 and 53, 53$^1$, 55, 55$^1$ in hub panel 13 as well as score lines 57, 57$^1$ and 59, 59$^1$ whereby the locking flaps may be folded inwardly when the reel is erected.

During some point in the manufacture of the blanks the anchor panel 1, the glue panel 5, the first outer side panel 7 and the second major reinforcing panel 19 are provided with a coating of adhesive in the pattern generally as shown in FIG. 1. This coating is preferably confined to narrow bands 60, 61, 62, 63, 64 and 65 disposed on the surface of the panel facing upwardly as disclosed in FIG. 1.

A plurality of bands of adhesive 67, 69, and 66 are provided on the undersurface of the first minor reinforcing panel 11 and the anchor reinforcing panel 1, respectively as shown in dotted lines also in FIG. 1. A further band of adhesive is provided on the underside of the second major reinforcing panel 19. This band does not appear in the drawing but is approximately in registry with adhesive band 65 on the upper surface of panel 19 as shown in the drawing, FIG. 1.

Obviously, there is a certain degree of latitude in where or in what form the adhesive coating is applied. It suffices to say that the coating is applied in narrow bands simply as an economy means. Further while the bands are shown as disposed on specific panels, it should be obvious that they could be just as well transferred to other panels against which the specified panels are folded into face-to-face abutment, as will be described hereinafter. The critical factor is, then, that certain panels are adhered in face-to-face relationship when the blank is folded in proper sequence.

The adhesive itself may be of any of a variety of types of commercially available products in common use in the box industry, such as ordinary, water based glue. Additionally, the areas of the blank to which the adhesive is applied may be perforated or roughened in any known manner to facilitate penetration of the adhesive into the blank to improve the bonding of the panels when the blanks are folded into knock down form.

The folding sequence whereby a reel is formed can best be understood by reference to FIG. 3. Panels 7 and 9 are folded into face to face contact along score line 37 and secured by the adhesive bands on panel 7. Panel 11 is reverse folded along score 39 against reinforcing panel 9 and is adhered thereto by adhesive bands 69 and 67 and this secured in the position (i.e. position when erected) shown in FIG. 3.

Panel 5 is folded into abutment with panel 11 to thereby define one reel flange having a three ply thickness over the majority of the reel end area. The two hub panels 3 and 13 are now folded into parallel relationship. The second major reinforcing panel 19 is folded against the second outer side panel 17 and adhered thereto by adhesive bands 64 and 65. Anchor reinforcing panel 1 is now folded into face to face abutment with the second major reinforcing panel 19 and adhered thereto by adhesive band 60 and the adhesive band not shown but previously described. The final fold brings second minor reinforcing panel 15 into face to face contact with anchor panel 1 to which it is adhered by adhesive band 68. Again the reel flange is comprised of three plys of the blank material over a majority of its surface area.

When erected in the manner just described a flanged reel is formed. In practice, however, the panels are simply adhered to one another in proper sequence with the result that a flat reel blank is formed. Thus the blanks can be readily shipped to its place of use. When ready to be used the reel flanges are rotated in the direction of the arrow as shown in FIG. 3 and moves to erect position about score lines 33, 41, 31 and 43 until the flanges are disposed in a parallel position. Then locking flaps 23 and 23 and 23¹ and 25¹ are folded into overlying position with the locking tabs 27, 27¹ snapped into apertures 29, 29¹ and the reel is ready to receive the product. Thus the reel has the shape and appearance as illustrated in FIG. 3.

By using the folding sequence and structure described above, the reverse or inside surface (meaning inside or inwardly of the reel) is out of sight, hence, one only has to print on one side, the so-called outside surface of the reel flanges to wit, panels 7 and 17. This permits the use of unbleached board or paperboard coated on one side or laminated on one side as the case may be.

Having described my invention in detail, it will be understood that various modifications will ocurr to those skilled in the art, all falling within the spirit and scope of the invention as defined by the following claims, wherein what is claimed is:

1. An improved reinforced reel of one piece of foldable material with an outside surface and an inside surface comprising:

first and second outer side panels each shaped like the intended reel flange and having said outside surface facing outwardly of the reel and said inside surface facing inwardly of the reel, said panels being arranged in spaced apart substantially parallel reltionship relative to each other;

first and second major reinforcing panels of the same configuration as said outer side panels;

said first and second major reinforcing panels hingedly connected to one side of each of the outer side panels and folded against and secured to the inside surface of said outer side panels;

a first minor reinforcing panel being hingedly connected to the opposite side of, reversely folded against the inside surface of, and secured to said first major reinforcing panel; said first minor reinforcing panel being of a size and shape to cover a major area of the inside surface of said first outer side panel and said first major reinforcing panel;

first and second hub panels arranged in respective substantially parallel planes which are substantially perpendicular to the planes in which said outer side panels are disposed, said hub panels both located between said outer side panels and spacing apart the outside panels and their respective reinforced panels;

said second hub panel being hingedly connected on one edge to the other edge of the first minor reinforcing panel;

a glue panel hingedly connected by its opposite sides between said first hub panel and said first outer side panel, respectively, and reversely folded against and secured into surface to surface contact with said first minor reinforcing panel;

an anchor reinforcing panel hingedly connected to said first hub panel on the edge opposite said glue panel and positioned adjacent to and secured to said second major reinforcement panel when the latter is in its folded position; said anchor reinforcing panel being of a size and shape to cover a major area of the inside surface of said second outer side panel and said second major reinforcing panel; and a second minor reinforcement panel being hingedly connected between and to the other side of said second hub panel and said second outer side panel and folded to lie in contact with said anchor panel when said anchor panel is adhered to said second major reinforcement panel;

whereby each outer side panel is reinforced over a major portion of its surface area by at least three plies of material.

2. An improved reel according to claim 1 wherein each hub panel has on each end a locking flap which is foldable inwardly of the reel toward and in over-lapping relationship with the corresponding flap from the other hub panel.

3. An improved reel as defined in claim 2 including inter-engageable locking tabs and apertures carried by the locking flaps for locking said flaps in over-lapped engagement.

4. An improved reel according to claim 1 wherein said glue panel and said second minor reinforcing panel respectively reinforce the upper edge of one and the lower edge of the other of said side panels.

5. An improved reel according to claim 1 wherein said anchor reinforcing panel, said first and second major reinforcing panels, said first and second outer side panels and said first minor reinforcing panel are provided with apertures adapted to be in registry when said reel is erected to permit use thereof on a conventional winding machine.

6. An improved reel according to claim 1 wherein said anchor reinforcing panel, said glue panel, said first outer side panel and said second major reinforcing panel are provided with an adhesive coated area on the same side of the unfolded piece of material.

7. An improved reel according to claim 6 wherein said anchor reinforcing panel, said first minor reinforcing panel and said second major reinforcing panel are provided with adhesively coated areas on their opposite sides.

8. An improved reel according to claim 7 wherein the adhesively coated areas of said panels embody means to facilitate penetration of the adhesive into said foldable material.

9. A blank for making an improved reinforced reel of one piece of foldable material having an upper surface and a lower surface comprising:

first and second outer side panels each shaped like the intended reel flange, said panels being arranged in substantially parallel but spaced relationship relative to each other along the blank;

first and second major reinforcing panels of the same configuration as said first and second outer side panels, each of said major reinforcing panels being hingedly connected along one edge to the respective outer side panel it reinforces, each of said major reinforcing panels being foldable so as to lie in contact with the respective outer side panel it reinforces;

a first minor reinforcing panel hingedly connected along one edge to said first major reinforcing panel on the edge opposite said first outer side panel, said first minor reinforcing panel being foldable so as to be in contact with said first major reinforcing panel, said first minor reinforcing panel further being of a size and shape to cover a major area of said first major reinforcing panel and said firt outer side panel when said first minor reinforcing panel, said first major reinforcing panel, and said first outer side panel are in the folded position;

a glue panel, hingedly connected along one edge to said first outer side panel on the edge opposite said first major reinforcing panel, sid glue panel being foldable so as to lie in contact with said first minor reinforcing panel;

a first hub panel, hingedly connected along one edge to said glue panel, on the edge opposite said first outer side panel, said firt hub panel being foldable so that it lies in a plane substantially perpendicular to the planes in which said first and second outer side panels are disposed;

an anchor reinforcing panel hingedly connected along one edge to said first hub panel on the edge opposite said glue panel, said anchor reinforcng panel being foldable so as to lie in contact with said second major reinforcing panel; said anchor reinforcing panel further being of size and shape to cover a major area of said second major reinforcing panel and said second outer side panel when said anchor reinforcing panel, said second major reinforcing panel, and said second outer side panel are in the folded position;

a second hub panel, hingedly connected along one edge to said first minor reinforcing panel on the edge opposite said first major reinforcing panel, said second hub panel being foldable so as to lie in a plane substantially parallel to the plane in which said first hub panel is disposed, and in a plane substantially perpendicular to the planes in which said first and second outer side panels are disposed; and a second minor reinforcing panel, hingedly connected along one edge to said second hub panel on the edge opposite said first minor reinforcing panel, and along the other edge to said second outer side panel on the edge opposite said second major reinforcing panel, said second minor reinforcing panel being foldable so as to be in contact with said anchor reinforcing panel.

10. A blank as defined in claim 9 wherein said anchor reinforcing panel, sid glue panel said first outer side panel and said second major reinforcing panel are provided with an adhesively coated area on the same side of the unfolded piece of material.

11. A blank as defined in claim 9 wherein said hub panels are provided with locking flaps at each end, said flaps being provided with locking means for use in locking said flaps to hold the blank in reel configuration after it is folded.

12. A blank as defined in claim 10 wherein said anchor reinforcing panel, said first minor reinforcing panel and said second major reinforcing panel are provided with adhesively coated areas on their opposite sides.

13. A blank as defined in claim 10 wherein the adhesively coated areas of said panels embody means to facilitate penetration of the adhesive into said foldable material.

* * * * *

UNITED STATES PATENT OFFICE

CERTIFICATE OF CORRECTION

Patent No. 4,019,692 Dated April 26, 1977

Inventor(s) Wallace E. Hanson

It is certified that error appears in the above-identified patent and that said Letters Patent are hereby corrected as shown below:

Column 2, line 19, after second (first occurrence) delete "major" and insert -- major -- after "second" (second occurrence).

Column 2, line 31, delete "$23^1$" and insert -- 23' --.

Column 3, line 7, delete "means" and insert therefore -- measure --.

Column 5, line 48, delete "firt" and insert therefore -- first --

Column 5, line 55, delete "sid" and insert therefore -- said --

Column 6, line 5, delete "firt" and insert therefore -- first --

Column 6, line 14, after "of" insert -- a --

Column 6, line 37, delete "sid" and insert therefore -- said --

Signed and Sealed this thirtieth Day of August 1977

[SEAL]

Attest:

RUTH C. MASON
Attesting Officer

C. MARSHALL DANN
Commissioner of Patents and Trademarks